US006563525B2

(12) United States Patent
Suzuki

(10) Patent No.: US 6,563,525 B2
(45) Date of Patent: May 13, 2003

(54) RECORDING APPARATUS

(75) Inventor: Etsuro Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 09/796,472

(22) Filed: Mar. 2, 2001

(65) Prior Publication Data

US 2001/0022609 A1 Sep. 20, 2001

(30) Foreign Application Priority Data

Mar. 13, 2000 (JP) ..... 2000-068021

(51) Int. Cl.[7] ..... B41J 11/00
(52) U.S. Cl. ..... 347/218
(58) Field of Search ..... 347/218, 220, 347/221, 222, 172, 177, 178, 197; 400/120.16, 120.11, 120.02, 624; 399/401, 402; 206/449; 271/145

(56) References Cited

U.S. PATENT DOCUMENTS 4,845,549 A * 7/1989 Someya ..... 358/503
4,957,689 A * 9/1990 Ohnishi et al. ..... 346/134
5,296,874 A * 3/1994 Nagata et al. ..... 101/409
5,474,394 A 12/1995 Koike et al. ..... 400/120.02
5,651,620 A * 7/1997 Paranjpe ..... 400/120.02
6,227,732 B1 * 5/2001 Higuchi et al. ..... 206/449
6,392,682 B2 * 5/2002 Ozawa ..... 347/197

FOREIGN PATENT DOCUMENTS

| | | |
|---|---|---|
| JP | 2824498 | 11/1998 |
| JP | 2898178 | 5/1999 |
| JP | 11-123838 | 5/1999 |
| JP | 11-138875 | 5/1999 |

* cited by examiner

*Primary Examiner*—Lamson Nguyen
*Assistant Examiner*—K. Feggins
(74) *Attorney, Agent, or Firm*—Fitzpatrick, Cella, Harper & Scinto

(57) ABSTRACT

A recording apparatus capable of recording on each of various recording sheets having different sizes by replacing recording material cassettes, and, capable of executing color recording or the like in plural colors, which requires the repetition of reciprocating conveyance of the recording sheet despite the apparatus main body which is structured sufficiently small, and, further, the apparatus is capable of automatically performing double side recording by replacing the recording material cassettes.

15 Claims, 7 Drawing Sheets

RECORDING APPARATUS

BACKGROUND OF THE INVENTION

1. Field of the Invention

The present invention relates to a recording apparatus having a detachably mountable cassette of recording material mounted thereon to record on a recording material by use of recording means in accordance with recording information.

2. Related Background Art

As a recording apparatus, there has been known the thermal transfer recording apparatus of line recording type (printing apparatus of thermal transfer type) that uses a thermosensitive sheet as a recording material (recording medium), such as recording paper sheet, and records images on the recording material one after another per dot line by driving selectively a plurality of heat generating elements arranged for the apparatus in the widthwise direction of the recording material to be carried, and by carrying the recording material at the same time. In recent years, along with the advancement of input device, such as a digital camera, a digital video camera, or a scanner, that serves as equipment dealing with images on the input side, the aforesaid thermal transfer type recording apparatus has again attracted attention.

This is because the thermal transfer type recording head can easily change the quantities of heat which is made controllable per pixel, and provide various gradations per pixel, as well as a printed image finished in as good quality as a silver salt photograph, together with the enhanced performance of thermal head and the improvement of sheet material to be used. Under the circumstances, there have been filed many patent applications for recording apparatuses for use of natural image representation, in particular, so as to keep abreast with the technical advancement of digital cameras in recent years.

For example, an art is disclosed in the specification of Japanese Patent Application No. 11-123838, which relates to cooling the heating head of a sublimation type printing apparatus (sublimation type recording apparatus). With this art, a cooling fan is installed for a carriage member that includes a thermal head. This is effective as a heat control measure needed for a thermal head.

Also, in the specification of Japanese Patent Publication No. 2824498, there is disclosed an art which relates to the carrying passage of a recording apparatus. In accordance with this art, recording sheets (printing sheets) are kept in stack inside the inner housing supported to be made inclinable in the outer housing, and a recording sheet (printing sheet) on the lowest layer is pressed to a sheet feeding roller by biasing both the inner housing and the upper portion of recording sheet downward by use of each biasing means, and then, the recording sheet is fed out from the sheet feeding port arranged for the bottom of the outer housing by the rotation of the sheet feeding roller effectuated in such condition described above, hence feeding sheet more reliably. In this way, the carrying passage of a recording sheet is made shorter between the sheet feeding unit and the recording unit (printing unit).

Also, in accordance with an image recording apparatus described in the specification of Japanese Patent Application No. 11-138875, an art is disclosed to make it possible for the recording apparatus to record (print) on the surface side and backside of a recording sheet. The image recording apparatus thus disclosed provides a structure capable of implementing the sublimation recording that records high quality full color images on the surface side of a recording sheet prepared for sublimation use, and also, implementing thermofusion image recording on the back side thereof in an optimal heating condition suitable for such recording by use of only one recording apparatus. This structure is extremely effective when recording is made on both sides of a recording sheet.

However, these prior examples haven not been good enough as yet to solve problems related to making a recording apparatus smaller and performable at higher speed. For example, the recording apparatus disclosed in the specification of Japanese Patent Application No. 11-123838 adopts the structure where a cooling fan is provided for the carriage member that includes a thermal head. As a result, the size of the recording apparatus is made larger (dimension increases) in the height direction inevitably. There is of course a case where the larger size of a recording apparatus does not present any problem should no restriction be imposed upon the installation site such as in an office arranged for business activities. However, for family use in general, the smaller the better. In other words, one of the reasons that the family use thereof has not been promoted as anticipated despite the good quality obtainable by the recording apparatus of the kind is that the apparatus is not small enough. It is prerequisite that the recording apparatus of the kind is made smaller in order to promote its family use in general.

Also, for the recording apparatus disclosed in the specification of Japanese Patent Publication No. 2898178, the structure is arranged to make it possible to shorten the carrying passage according to the description thereof. This apparatus is effective to make the carrying passage shorter. On the other hand, however, the inner structure is liable to become more complicated if it is intended to miniaturize the apparatus main body, and also, the structure, in which the inner housing is supported to be made inclinable in the outer housing, is not necessarily considered effective in making the apparatus main body smaller. The disclosed apparatus is still insufficient after all even only from the viewpoint of making the apparatus main body smaller. Also, for the conventional recording apparatuses, most of them are structured to allow the sheet cassette (recording material cassette) that contains recording sheets (recording material) to be protruded largely from the front side of the apparatus main body when installed at the time of recording (printing).

In this case, it is necessary to execute recording (printing) by the recording apparatus which should be brought out to be set each time from the place where it is usually kept or by securing a sufficiently large space on the location where the sheet cassette is handled for installation in the recording apparatus so that the sheet cassette can be inserted without any obstacle for recording each time it is used. In the latter case, the sheet cassette is removed from the apparatus main body and stored in some other place or the like. An operation of the kind is extremely nuisance. These unfavorable handling requirements should be another reason to impede the promotion of family use of the recording apparatus of the kind in general.

With a view to solving such technical problems as described above, there have been proposed in recent years recording apparatuses which are structured to contain the sheet cassette in the interior of the apparatus main body. The operativity of a recording apparatus of the kind that has a sheet cassette incorporated in it is excellent, and expected to become one of the leading devices in the future. At the present, however, the structure of the apparatus main body still remains unchanged, hence making the recording apparatus extremely long eventually in the directions forward and backward. Here, therefore, such a recording apparatus has been proposed as to adopt a structure in which the print engine mechanism (recording operation mechanism) that has been arranged in the recording apparatus in the directions forward and backward thereof conventionally is rotated 90 degrees to be arranged in the horizontal direction so that the sheet cassette is drawn out in the direction at 90 degrees to the recording direction. However, the recording apparatus thus structured becomes extremely large in the horizontal direction, and does not contribute to embodying a smaller apparatus as desired. The status quo is still the same.

Also, the recording apparatus having the recording engine (print engine) arranged in the horizontal direction is such as to automatically limit the size of a recording sheet that can be contained in the sheet cassette. In other words, if, for example, recording should be made on a recording sheet of panoramic size (a panorama sheet), which has a horizontal length approximately twice the size of standard size recording sheet (an ordinary post-card size sheet, for instance), it is impossible to record (print) on such a long recording sheet in case where the size of the sheet cassette is determined by the size of the apparatus main body, hence inevitably restricting the usage of a recording apparatus of the kind.

As described above, there has been conventionally technical difficulties in providing a recording apparatus capable of complying with the user's request that each of the various kinds of recording is possible (particularly, recording is possible on each of the various kinds of recording sheets having different sizes), while coping with both the provision of a smaller main body of the apparatus, and the maintenance of desirable container functions of sheet cassette at the same time. It is apparently conceivable that the various kinds of recording thus required here should include the function to perform the double side recording where recording is made on both the surface side and backside of a recording sheet. For a double side recording of the kind, a recording apparatus is disclosed in the specification of Japanese Patent Application No. 11-138875, but it requires the user to input a recording sheet prepared for sublimation use into the apparatus reversely, and change the operational mode of mode setting means to enable the reverse recording mode to be executable. The user tends to find these operations extremely nuisance. There is a drawback that handling is not easy, either.

Here, this technical problem that various kinds of recording should be made possible while coping with both the provision of smaller main body of an apparatus and the maintenance of the desirable container function of sheet cassette is also concurrently encountered when designing the recording apparatus of ink jet type that uses an ink jet recording head as recording engine (print engine).

SUMMARY OF THE INVENTION

The present invention is designed in consideration of the technical problems discussed above. It is an object of the invention to provide a recording apparatus capable of easily and reliably recording on each of various recording materials which are different in sizes even with the apparatus main body minimized in size just by replacing the recording material cassettes, and also, capable of easily and reliably executing on each of various recording materials which are different in sizes the color recording that requires the repetition of reciprocating conveyance of the recording material through the recording unit.

It is another object of the invention to provide a recording apparatus which is made still smaller but capable of automatically performing double side recording just by replacing recording material cassettes in addition to the object described above.

It is still another object of the invention to provide a recording apparatus, which is provided with a detachably mountable recording material cassette for supplying recording material for recording on recording material by means of a recording head in accordance with recording information, comprising a carrying passage for recording material formed on a part of recording material cassette, and a carrying passage for the recording material formed in the interior of apparatus main body, and then, a carrying passage formed by the carrying passage formed on the recording material cassette and the carrying passage formed in the apparatus main body, which is provided with a curved carrying path to be curved on the front and backsides of recording apparatus, and a recording unite arranged between the curved carrying passages to perform recording on the way of the carrying passage formed for the apparatus main body.

It is a further object of the invention to provide a recording apparatus, which is provided with a detachably mountable recording material cassette for supplying recording material for recording on recording material by means of a recording head in accordance with recording information, comprising a first carrying passage for recording material formed on a part of recording material cassette, a second carrying passage for the recording material formed in the interior of apparatus main body, a third carrying passage formed by connecting the first carrying passage and the second carrying passage, which is provided with a curved carrying path to be curved on the front and back sides of recording apparatus, and a recording unite arranged on a location along the second carrying passage positioned to face the first carrying passage for holding the recording head.

It is still a further object of the invention to provide a recording apparatus for recording on recording material by means of a recording head held in a recording unit, which comprises a recording material cassette for containing recording material, which is installed on the upper side of the recording unit inside apparatus main body, and detachably mountable in the same direction as the direction of carrying recording material during recording, and carrying means for expelling recording material from apparatus main body after guiding the recording material from the recording material cassette to the recording unit, which is arranged to carry recording material from the backside of apparatus main body into the interior of apparatus main body, at the same time, reversing recording material during recording from the front side in the interior of apparatus main body for guiding the recording material to the recording unit, and expelling the recording material after completion of recording from the rear side of upper face of apparatus main body toward the front side thereof.

DETAILED DESCRIPTION OF THE PREFERRED EMBODIMENTS

Hereinafter, with reference to the accompanying drawings, the description will be made of the embodiments in accordance with the present invention.

Figure 1:
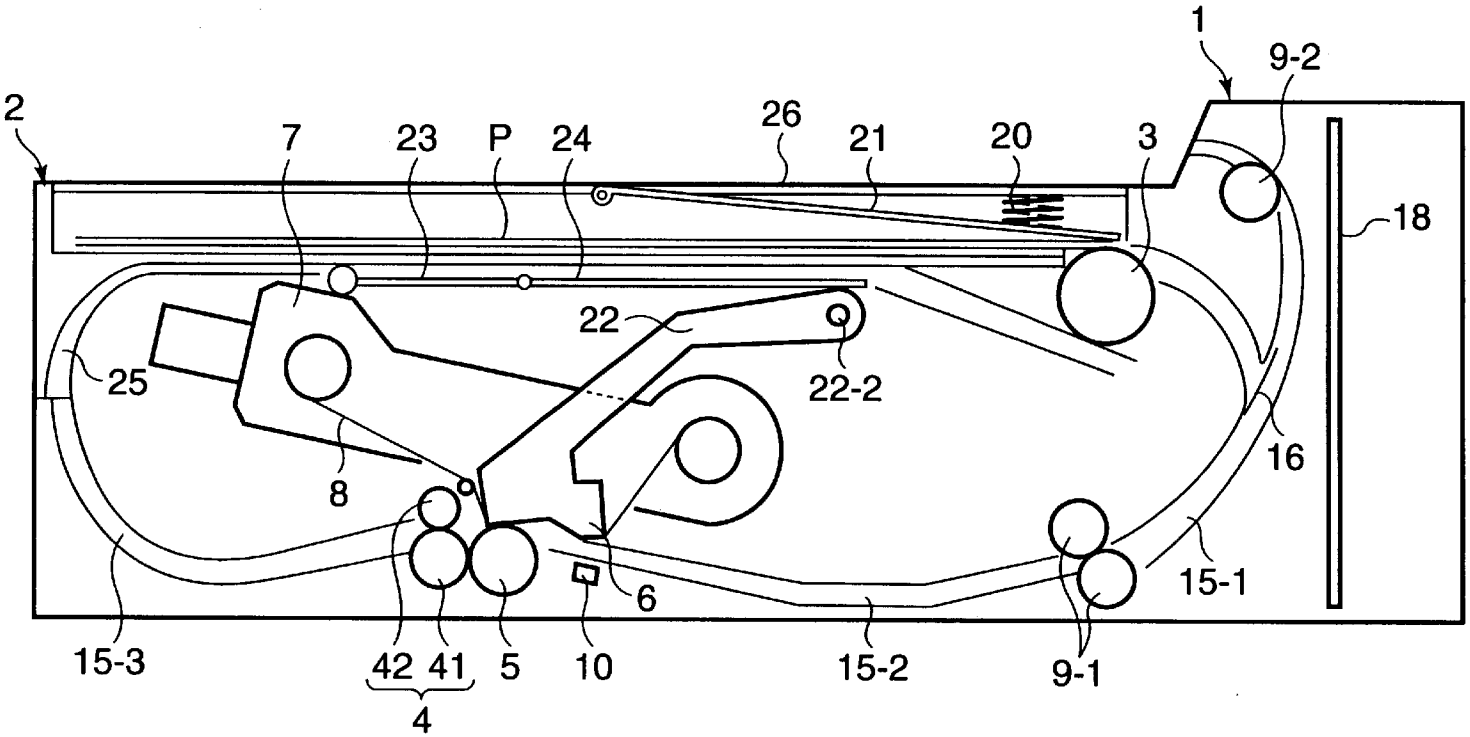
FIG. 1 is a side view which schematically shows the structure of one embodiment of the recording apparatus to which the present invention is applicable.

FIG. 1 is a side view which schematically shows the structure of one embodiment of the recording apparatus to which the present invention is applicable. The recording apparatus shown in FIG. 1 is described by exemplifying a thermal transfer type recording apparatus that uses thermal transfer type recording means (thermal head) as the recording unit (printing unit) of sublimation type therefor to record (print out) electronic image information on an arbitrary number of recording sheets. In FIG. 1, the sheet cassette 2 having recording material P, such as recording sheets, stacked therein is detachably mounted on the apparatus main body 1. When the sheet feed roller 3 is driven, while the sheet cassette 2 is mounted, the recording material (recording sheets) P are separated from the sheet cassette 2 one by one to be fed to the recording unit of the apparatus main body. At this juncture, the recording sheet P is in contact with the sheet feed roller 3 under pressure by manes of the push-up plate 21 which is biased downward by use of a spring 20. Also, the carrying passage switching sheet 16, which is arranged on the junction with the carrying passage of the apparatus main body 1, is released when feeding the recording sheet P.

Then, the recording sheet P carried forward by means of the sheet feed roller 3 (to the right in FIG. 1), and guided to the guide portion 15-1 of the carrying passage of the apparatus main body 1 by way of the aforesaid junction being in the state where the carrying passage switching sheet 16 is released, and further, fed into the carrying roller pair 4 through the first expelling rollers 9-1 which are separated (released), the guide portion 15-2, and the recording unit (between the platen 5 and the thermal head 6) which is separated (released). The aforesaid carrying roller pair 4 comprise a grip roller 41 and a pinch roller 42. The recording sheet P, which is fed into the carrying roller pair 4, is pinched by the grip roller 41 and the pinch roller 42 so as to be reciprocated (carried forward and backward) exactly through the recording unit by the rotation of the grip roller 41 which is controlled as required.

In the recording unit, the platen roller 5 and the thermal head 6 are arranged to face each other with the recording sheet carrying passage between them. The thermal head 6 records images on the recording sheet (recording material) P by heating the ink sheet 8 contained in the ink cassette 7 in accordance with recording information. The ink sheet 8 contained in the ink cassette 7 is provided with the ink layer formed by coating the thermofusion or thermal sublimation ink, and an overcoat layer which is over coated on the recording face to protect it. Then, the ink sheet 8 is pressed by the thermal head 6 to the recording sheet P, and selectively heated in accordance with recording information simultaneously to transfer designated images to the recording sheet P for recording. Further, the protection layer is over coated on it.

In this manner, with the provision of the thermal head 6 which serves as heating means having a plurality of heating elements formed in line, and the ink sheet 8 which is provided with the ink layer to be transferred to the recording sheet P, and the overcoat layer as well, images are transferred to the recording material P for recording when the ink sheet 8 is heated by heating means 6 in accordance with recording information. The recording apparatus of thermal transfer type is thus structured to serve the purpose.

The ink sheet 8 has the yellow (Y), magenta (M), and cyan (C) layers each covering the recording area of a recording sheet P substantially in the same size thereof, and the overcoat (OP) layer, which are superposed for the formation of the ink sheet. Then, in accordance with recording information, the thermal head 6 heats the ink sheet 8 for thermal transfer per layer, and the recording sheet P is returned to the recording start position P1 (not shown) per layer transfer, thus repeating the transfer recording for each layer one after another. In this way, the recorded images are formed by a plurality of ink layers which are transferred and superposed in the form of layers on the recording sheet P. In other words, when color recording is made as in the present embodiment, the recording sheet P is reciprocated (sub-scanned) by means of the carrying roller pair 4 in numbers corresponding to the number of color ink and overcoat layers. Then, the recording sheet P is fed in the left direction in FIG. 1 through the recording unit for recording on each of the ink layers, and the recording sheet P is reversed per completion of recording on each ink layer on the position where it is sufficiently carried forward (to the left in FIG. 1) of the apparatus main body 1, and the recording sheet P thus reversed is guided to the backside of the apparatus main body 1 (to the right in FIG. 1) by means of the carrying roller pair 4 through the guide portions 15-3 and 15-2, the released first expelling rollers 9-1, and others located on the front and lower part of the sheet cassette 2. Since the recording sheet P is carried to the front part (the left side portion in FIG. 1) of the apparatus main body per completion of recording and reversed on such position, there is no possibility that the recording sheet P is carried outside the apparatus main body 1 on the way of recording. Therefore, no excessive space is needed. It also becomes possible to prevent the recording sheet P from being touched unexpectedly. Thus, space saving is possible at the location where the recording apparatus is installed.

Furthermore, the recording sheet P is carried to the left in FIG. 1 by directly utilizing the sheet carrying guide portion 25 which is formed on the lower part of the sheet cassette 2 as paper guide. As a result, the thickness and length of the apparatus main body 1 can be reduced to make the dimensions thereof thinner and shorter. In addition, the recording sheet P can be carried (to the left in FIG. 1) through the space between the ink cassette 7 and the sheet cassette 2. This makes it possible to minimize the total height of the apparatus main body 1. With these arrangements, the recording apparatus can be made smaller almost to the minimum dimensional configuration. The sheet carrying guide portion 25 formed on the lower part of the sheet cassette 2 is the portion where the recording sheet P, which has been carried from the backside (the right side in FIG. 1) of the apparatus main body 1 to the left in FIG. 1, is reversed on the front side (the left side in FIG. 1) of the apparatus main body 1. Here, the provision of the sheet cassette 2 thus arranged contribute significantly to making the apparatus main body 1 smaller as a whole. Also, the upper face of the sheet cassette 2 is arranged to be an expelled sheet tray portion 26 to receive the recording sheet P which has been expelled after recording, and this formation of expelled sheet tray portion 26 by use of the sheet cassette 2 also contribute to making the apparatus main body 1 smaller.

In FIG. 1, the carrying roller pair 4 formed by the grip roller 41 and the pinch roller 42 are rotated regularly in a designated number to enable the recording sheet P to reciprocate in the designated number through the recording unit. During this period, each ink layer (each layer of Y, M, C, and OP) is transferred to complete recording. After that, the recording sheet P is guided to move by means of the first expelling rollers 9-1 and the second expelling roller 9-2, and expelled onto the expelled sheet tray portion 26 from the rear upper part of the apparatus main body 1 toward the front side thereof, thus completing the recording operation. The first expelling rollers 9-1 are formed to be pressed to the recording sheet only when the recording sheet P is expelled so as not to exert any stress upon the recording sheet P on recording.

In this respect, the apparatus main body 1 is provided with the guide portions 15-1, 15-2, and 15-3 for the recording sheet P in order to guide (conduct) the recording sheet P for the reciprocating movement thereof. For the outlet (junction with the first guide portion 15-1) of the carrying path through which the recording sheet P is fed out from the sheet cassette 2 by means of the sheet feed roller 3, the switching sheet 16 is arranged that serves as carrying passage switching means. In other words, only when the recording sheet P is fed, the switching sheet 16 is released. The switching sheet 16 is closed at any other time so as to conduct the sheet to the passage on the expelling side (that is, the path leading to the second expelling roller 9-2) after the recording sheet P has been fed.

The thermal head 6 for use of recording (printing) is integrally installed on the leading end of the head arm 22 which is swingably supported, and arranged to be retractable to a position where it does not impede the insertion and removal of the ink cassette when ink cassettes 7 are replaced. When the sheet cassette 2 is drawn out, the ink cassettes 7 can be replaced. Then, the retracting operation of the thermal head 6 is interlocked with the attachment or detachment of the sheet cassette when the sheet cassette 2 is drawn out. Then, the cam portion 2-1 (FIG. 4) of the sheet cassette 2, which is conditioned to press the cam portion 22-1 of the head arm 22, is retracted (separated) from the cam portion 22-1 to enable the head arm 22 to swing up and down, thus rotating upward to make this retracting operation possible.

The thermal transfer recording apparatus shown in FIG. 1 records by superposing plural colors (three colors) of Y (yellow), M (magenta), and C (cyan) one after another while the recording sheet P is reciprocated (sub-scanned) in plural times. As a result, it is necessary to control and keep each head of recording (that is, the position at which recording should begin) for each color to be in agreement exactly. To this end, the recording sheet P should be pinched exactly by means of the carrying roller pair 4 formed by the grip roller 41 and the pinch roller 42, which necessitates the provision of unrecordable margins each on the edge portion of the recording sheet P in the carrying direction (direction of conveyance).

Figure 3:
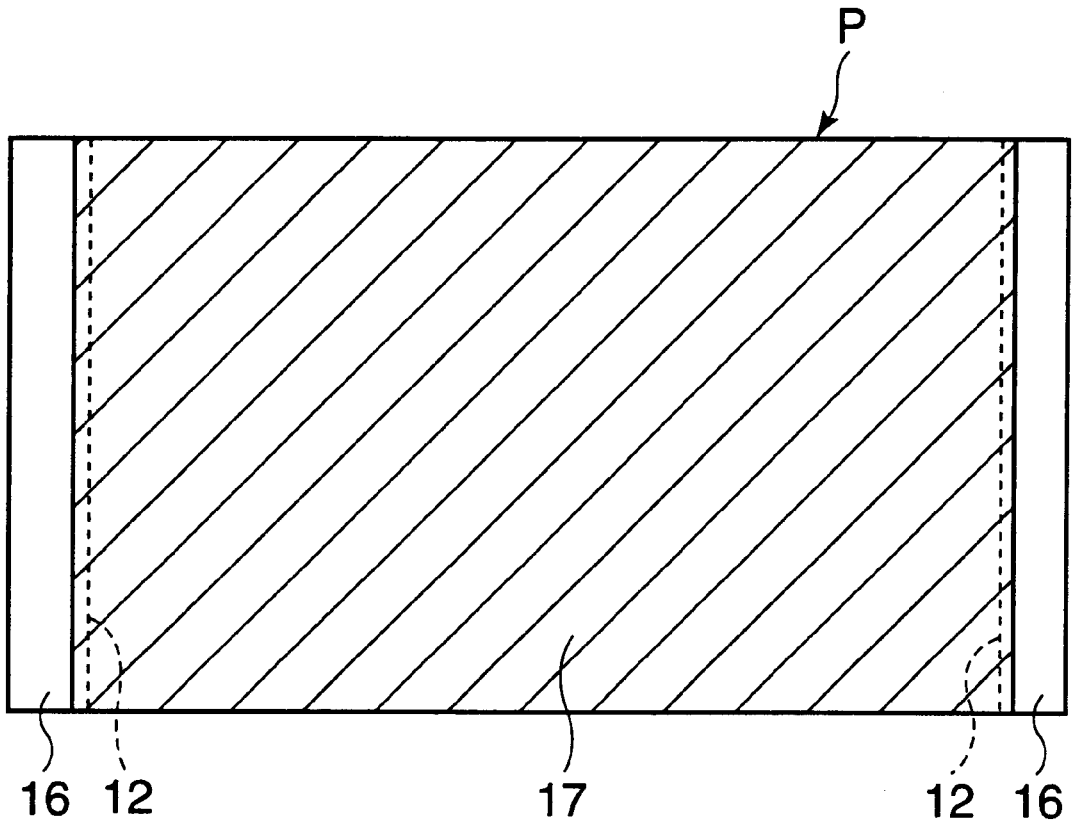
FIG. 3 is a view which schematically shows one example of the recording material to be used for the recording apparatus represented in FIG. 1.

FIG. 3 is a view which schematically shows a recording sheet (recording material, recording object) P to be used for the recording apparatus represented in FIG. 1. As described above, there is a need for providing margins. Therefore, in order to obtain a recording object without any edges (margins) ultimately, it is necessary to make an arrangement so that the recording object can be pinched by the carrying roller pair 4 exactly when recording is started, and then, the margins 16 where recording cannot be made are cut off later. To implement this, perforations 12 are provided for both edge portions of recording sheet P as shown in FIG. 3.

In accordance with the present embodiment, the recording operation is executed by use of the recording sheet P having perforations 12 as described above, and the thermal transfer recording apparatus shown in FIG. 1. Then, each area having perforation 12 on the recording sheet P is overcoated. Also, the area indicated by lines slanted to lower left in FIG. 3 is the recordable area 17, which is controlled so as to perform recording on the area including each of the perforations 12. Here, the range where the overcoating is transferred is the area on most of which recording is made. Usually, such range is set slightly larger than the recordable area (in order to include the aforesaid recording area 17). In other words, control is made so that recording is made in the range of recording area 17 which is set slightly wider in order to include the perforations 12.

For the recording apparatus shown in FIG. 1, the carrying roller pair 4 are formed by the grip roller 41 and the pinch roller 42, and the output shaft of a stepping motor (not shown) is directly connected with the grip roller 41 through a reduction mechanism. The grip roller 41 is driven to rotate regularly or reversely by the rotational control of the stepping motor. The recording sheet P is reciprocated while being pinched exactly (firmly) by means of carrying roller pari 4. Therefore, the recording sheet P is driven to be carried accordingly with the exact positional control effectuated by the rotational control of the stepping motor.

Now, as one example, given the recording pitch of one line portion by means of the thermal head 6 as 85 $\mu$m, and the step number of the stepping motor for carrying the recording sheet P for one line portion as 4 steps, the recording sheet P is carried by one line (that is, 85 $\mu$m) by controlling the stepping motor to rotate 4 steps. Now, if the recording area (recording range) 17 shown in FIG. 3 is 144 mm in the carrying direction, it is possible to record 1,694 lines in the recording area 17. To carry the recording sheet P accordingly, the stepping motor should rotate 6,776 steps.

For the recording apparatus shown in FIG. 1, the recording sheet leading end detection sensor 10 is arranged in the vicinity of the carrying roller pair 4 in the sheet conduction passage from the sheet feed roller 3 to the carrying roller pair 4. The leading end of the recording sheet P is detected by this recording sheet leading end detection sensor 10, and subsequently, when the recording sheet P is carried by the designated line portions within the range where it can be pinched by means of the carrying roller pair 4, the sheet feeding is suspended. This position becomes the aforesaid position where recording begins (that is, the aforesaid recording start position).

Form this condition, in synchronism with the sheet feeding operation to pitch feed the recording sheet P toward the guide portion 15-3 and the sheet carrying guide portion 25 (to move and sub-scan it in the left direction in FIG. 3), the designated image is at first recorded in yellow by driving the thermal head 6 to heat the yellow ink layer in accordance with the Y (yellow) recording information. Then, when one color recording (in this case, yellow color) is completed, the recording sheet P is carried from this position to be returned in the direction toward the location where the first sheet expelling roller pair 9-1 and the second sheet expelling roller 9-2 are arranged (in the right direction in FIG. 3), and then, set once again at the aforesaid recording start position. After that, while being carried on for the designated number of lines in the left direction in FIG. 3, the designated image is recorded in the next color (in this case, magenta M) in accordance with the next color information. Thus, the operation is repeated four times to execute the thermal transfer recording of each of the three colors, Y (yellow), M (magenta), and C (cyan), respectively, and the thermal transfer of the overcoat layer.

For the recording apparatus shown in FIG. 1, the distance from the position of the recording sheet leading end detection sensor 10 to the position where the recording sheet P is pressed by the platen roller 5 and the thermal head 6 is approximately 20 mm, for example, in terms of the distance on the recording sheet P, in consideration of the arrangement of each component in the apparatus. Of course, however, the distance is not necessarily limited to this value. In this respect, such recording object (recording sheet P) as shown in FIG. 3 is obtainable by the transfer of each color ink layer and the transfer of overcoat layer as described below.

Figure 2:
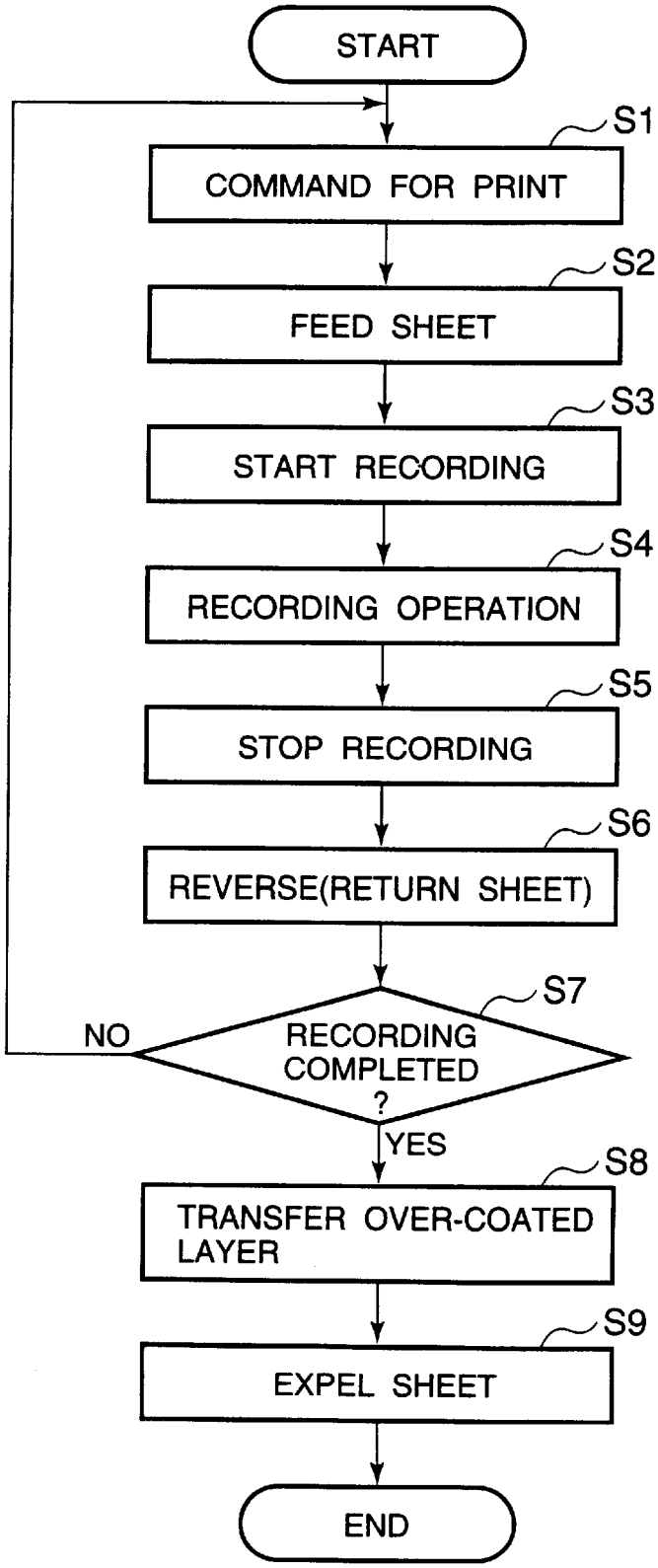
FIG. 2 is a flowchart which shows the operation of the recording apparatus represented in FIG. 1.

FIG. 2 is a flowchart which shows the operation of the thermal transfer recording apparatus, to which the present invention is applicable, in accordance with the first embodiment (described in conjunction with FIG. 1). Now, hereunder, with reference to the flowchart shown in FIG. 2, the description will be made of the sequence of thermal transfer of each color ink layer and that of the overcoat layer.

In FIG. 2, at first, the user instructs a printing operation (recording operation) in step S1 by use of a printing button (not shown) or a recording instruction form a personal computer or the like. Then, process proceeds to step S2, and using the processing circuit 18 in the apparatus main body 1 the image processing is executed to provide recording information, and then, when the preparation of recording (printing) is completed, control means (not shown) drives a motor (not shown) connected with the sheet feed roller 3 to begin feeding the recording sheet P from the sheet cassette 2.

Then, in step S3, the leading end detection sensor 10 detects the leading end of the recording sheet P which has been fed into the recording apparatus. Subsequent to having detected the leading end thereof, the stepping motor rotates by the designated number, and when the recording start position is reached, recording begins. The recording start position on the recording sheet P is then set at a position 12.465 mm inner side with the leading end as the criterion thereof. Next, in step S4, the stepping motor rotates 4 steps in succession, and during this rotation, the thermal head 6 is driven to heat for recording on one line portion. Then, it rotates in a total of 6,776 step portion (1,694 line portion) to complete the recording (printing) on the recording sheet P in the first color ink. The recording complete position then is a position at 156.455 mm with the leading end of the recording sheet P as the criterion thereof. Next, the stepping motor rotates approximately 10-line portion (40-step portion) for reduction until suspension, and then, the sheet feeding (conveyance) is suspended.

From this operational condition, the stepping motor is reversely driven to carry the recording sheet P to be returned by the designated step number (a total step number of 6,776 steps plus those used for reduction) in the direction (right direction in FIG. 1) which is opposite to the carrying direction thereof (left direction in FIG. 1) at the time of recording. Further, rotation is made at the designated line number (10 lines, or 40 steps, for instance) more or less for reduction, and then, suspended. Here, again in synchronism with the pitch feeding in the left direction, the next color ink layer is recorded and on. The recording operation described above is repeatedly executed for three colors, yellow (Y), magenta (M), and cyan (C) to record a desired recording image on a recording sheet P by means of transfer recording. After that, the same operation is further repeated once to transfer overcoat layer to protect the recorded image.

Subsequently, the stepping motor is reversely driven to carry the recording sheet P in the right direction in FIG. 1, and guide it to the expelling rollers 9-1 and expelling roller 9-2 as it is. Then, the recording sheet P having recorded images thereon is expelled onto the expelled sheet tray portion 26 by driving the expelling rollers 9-1 and expelling roller 9-2, hence completing a series of recording operations. In this respect, when the expelling rollers 9-1 and expelling roller 9-2 are allowed to be in a state of being pressurized (conditioned to pinch a recording sheet for carrying it) only when the recording sheet P is to be led out (expelled). On other occasions than this, such as at the time of feeding and recording, these rollers are released (separated) to allow the recording sheet P to pass freely.

In the aforesaid recording operation, control means controls the step numbers in the rotational driving of the stepping motor over the entire recording period in accordance with the step numbers of the stepping motor and the positional relations of the recording sheet P therewith during conveyance on the basis of the leading end detection signal of the recording sheet detected by use of the recording sheet leading end detection sensor 10 at the outset of feeding the recording sheet P. In this way, the recording positions are controlled. However, such control is not necessarily limited thereto. It may be possible to effectuate the leading end detection of a recording sheet with the provision of detection sensor on the leading end portion thereof at each time when each color ink (Y, M, and C) is transferred for recording, and also, when the overcoat layer is transferred for recording, and based upon each of the detection signals, the step numbers of rotation driving of the stepping motor is controlled per each transfer recording. Hence controlling the recording positions.

Also, in the aforesaid recording operation, the transfer of overcoat layer is executed only by turning on and off of the heat driving of the thermal head, but if required more, it may be possible to add such control as to gradually increase the heating amount at the time of initiating transfer of overcoat layer (at the initial stage), and to reduce it gradually at the time of finishing transfer of overcoat layer (at the ending stage).

Figure 4:
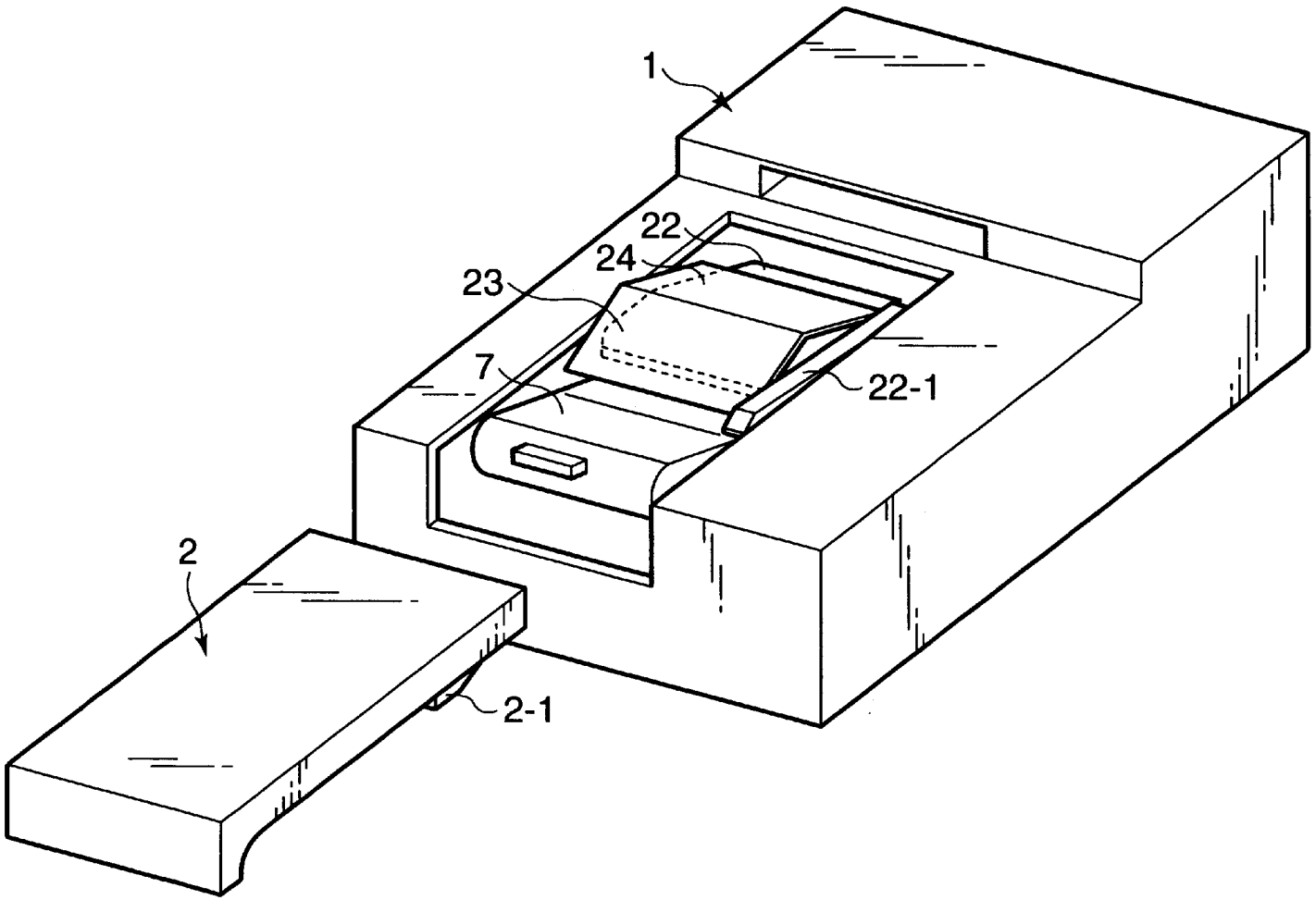
FIG. 4 is a perspective view which schematically shows the state where a sheet cassette is drawn out from the recording apparatus represented in FIG. 1.

FIG. 4 is a perspective view which schematically shows the state where the sheet cassette 2 is drawn out from the thermal transfer recording apparatus, to which the present invention is applicable, in accordance with the first embodiment (described in conjunction with FIG. 1). In FIG. 1 and FIG. 4, the ink cassette 7 is conditioned to be removed when the sheet cassette 2 is drawn out. At this juncture, the head arm 22 escapes in the direction in which it can be retracted from the ink cassette 7 by spring with the rotational center at 22-2 (that is, upward in clockwise direction in FIG. 1), thus enabling the ink cassette 7 to be in the removable condition. On the contrary, when the sheet cassette 2 is inserted (mounted), the head arm is set at the recording position (use position), because the cam portion 2-1 (see FIG. 4) formed on the lower end of the sheet cassette pressed down the cam portion 22-1 of the head arm 22.

Also, for the apparatus main body 1, there are provided the head covers 23 and 24 which are interlocked with the ascent and descent of the thermal head 6 (head arm 22). The head covers are formed by two head cover potions 23 and 24. The head cover portions 23 and 24 are coupled in the removing direction of the sheet cassette 2, which can be folded at the fulcrum thereof. Also, the structure is arranged so that the user cannot touch the thermal head 6 even if he intends to touch it. In this manner, it is designed to keep the user's safety, as well as to protect the thermal head 6. Also, the head cover portions 23 and 24 are structured to be housed in the state as shown in FIG. 1 when the sheet cassette 2 is inserted and mounted by being interlocked with the operation that enables the thermal head 6 to descend through the cam portion 22-1 of the head arm 22.

In accordance with the embodiment described above, the structure is arranged for the thermal transfer recording apparatus to record on the recording sheet P with fusion transfer of each color ink layer and overcoat layer coated on the ink sheet 8 by heating them in accordance with recording information using the thermal head 6 serving as heating means having a plurality of heating elements arranged in line. For this recording apparatus, the sheet cassette 2 that contains sheets (printing sheets) P is housed in the interior of the apparatus main body 1, and the sheet cassette 2 is arranged above heating means 6, and the sheet cassette 2 can be drawn out in the same direction as the printing direction (recording direction) to make it detachably mountable. Then, the printing (recording) sheet P is supplied from the backside of the apparatus main body 1, and the sheet P on the way of printing (recording) is reversed from the front side of the apparatus main body 1 and conducted to the sheet guide portion 25 on the front side between the heating means 6 and the sheet cassette 2. At the same time, the sheet P after printing (recording) has been completed lastly is expelled from the upper rear side of the apparatus main body 1 toward the front side.

With the structure thus arranged in accordance with the present embodiment, the sheet cassette 2 is detachably mountable in the printing direction on the upper part in the interior of the apparatus main body 1, and the sheet P is supplied from the backside of the apparatus main body, and at the same time, the printed sheet P is not allowed to be put out (projected) from the apparatus main body 1 from the time the sheet is supplied until it is expelled. The sheet is carried only within the interior of the apparatus main body, and expelled from the upper rear side of the apparatus main body. As a result, it becomes possible to provide a recording apparatus for which miniaturization is attainable for the main body thereof. Then, with the operation which is made possible from the front side, the user may find the apparatus to be easier to handle.

Also, in accordance with the present embodiment, the sheet cassette 2 containing printing sheets P can be attached or detached to and from the apparatus main body 1 horizontally in the front and backward direction, and interlocked with the removal of the sheet cassette 2 from the apparatus main body 1, the heating means (recording head) 6 is retracted upward automatically. Also, with the provision of the head covers (protection member and shielding member) 23 and 24 formed by plate members which can move interlocked with the ascent and descent of the heating means 6 between the heating means 6 and the sheet cassette 2, it becomes possible to avoid any trouble that the user touches heating means 6 unexpectedly.

Also, in accordance with the present embodiment, the structure is arranged so that the upper face of the sheet cassette 2 is utilized as the alignment tray of expelled sheets P after printing, and the lower face of the sheet cassette 2 is utilized as the guide portion to conduct sheet during printing. As a result, one component can perform plural functions to make it possible to miniaturize the apparatus main body to the smallest size. This also demonstrates an effective cost reduction.

Further, in accordance with the present embodiment, an effect is obtainable in that there is no danger of contact with heating means (recording head) 6 even when the possibility of contact becomes most liable along with the removal of the sheet cassette 2, because the structure is arranged to provide the plate members 23 and 24 so as not to allow the user to touch heating means 6 in the direction in which the sheet cassette 2 has been removed.

Furthermore, in accordance with the present embodiment, the plate members 23 and 24 are formed to dually serve as guide for sheet to be carried in a state where the sheet cassette 2 has been contained as clear from the arrangement structure shown in FIG. 1. Therefore, the members 23 and 24 perform plural functions to make it possible to miniaturize the apparatus main body 1 more to implement the cost reduction.

Figure 5:
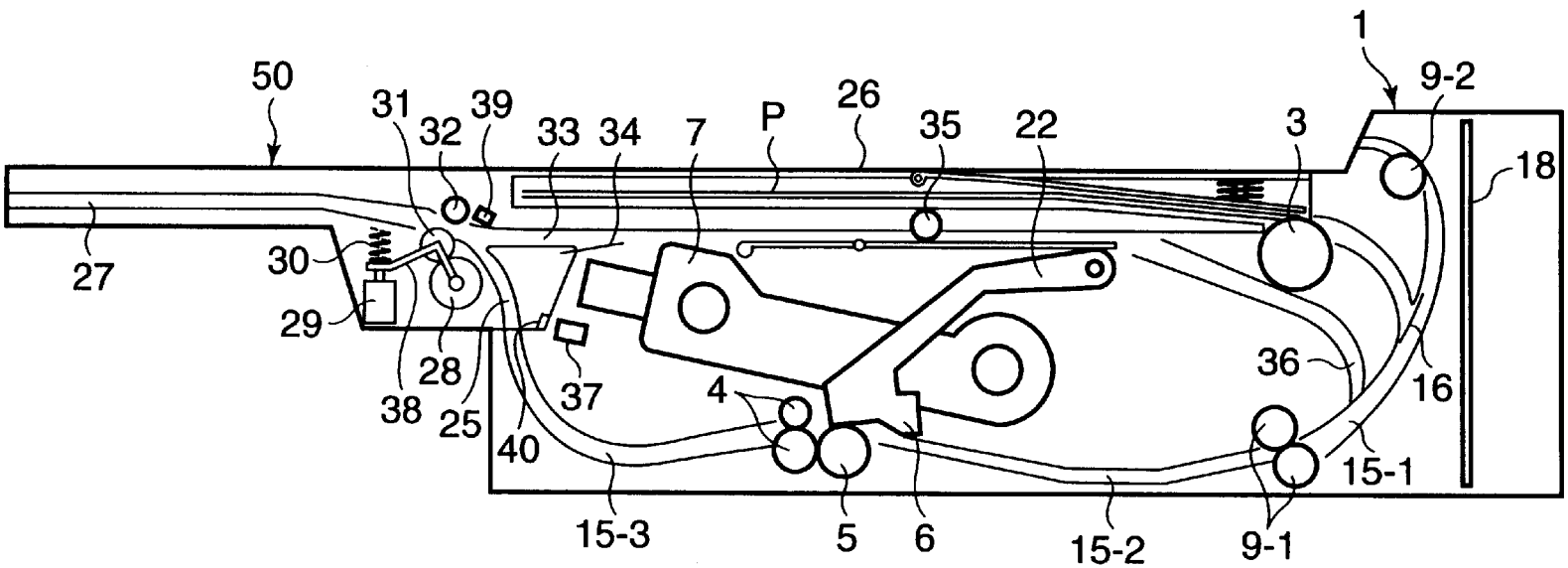
FIG. 5 is a side view which schematically shows the state where a sheet cassette that makes the double-side recording possible is mounted on the recording apparatus represented in FIG. 1.

FIG. 5 a perspective side view which schematically shows the state where the sheet cassette 50 that contains the recording sheet used for double side recording or the like is mounted in the recording apparatus represented in FIG. 1 instead of the sheet cassette 2. In FIG. 5, when the sheet cassette 50 usable for the double side recording is mounted, the cassette discrimination sensor 37 recognizes the installation of cassette in accordance with the configuration of the cassette discrimination mark 40. The supply of electric power to each operational unit of the sheet cassette 50 thus installed is made by control means (not shown) through contact means (not shown, either). Then, the driving system incorporated in the sheet cassette 50 can operate in accordance with instructions from the aforesaid control means. The user inputs the contents to be recorded (printed) on both sides into control means (not shown), and begins printing (recording) on the recording sheet P.

FIG. 6 to FIG. 9 are views which schematically illustrate the carrying conditions of a recording sheet (paper sheet) in the recording apparatus represented in FIG. 5, each condition being shown as the time elapses. With reference to FIG. 5 to FIG. 9, the description will be made of the carrying conditions of the recording sheet P along with the recording operation.

Figure 6:
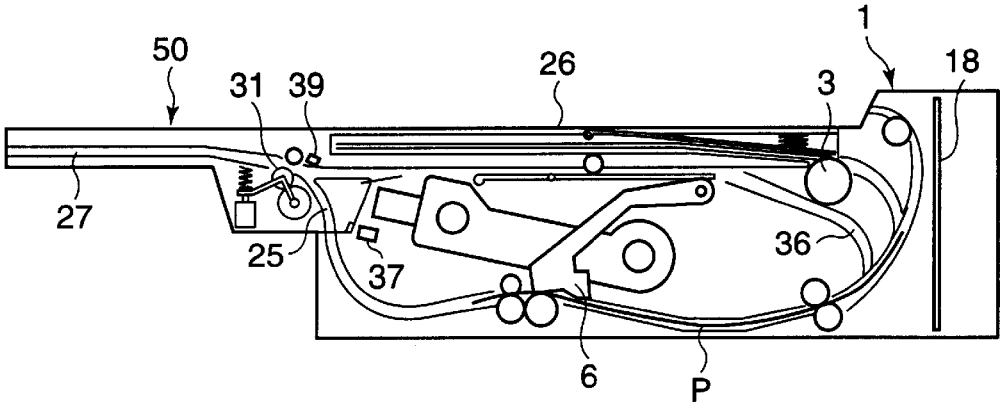
FIG. 6 is a side view which schematically shows the state where recording is made on the front side of the recording material after being fed into the recording apparatus represented in FIG. 5.
Figure 7:
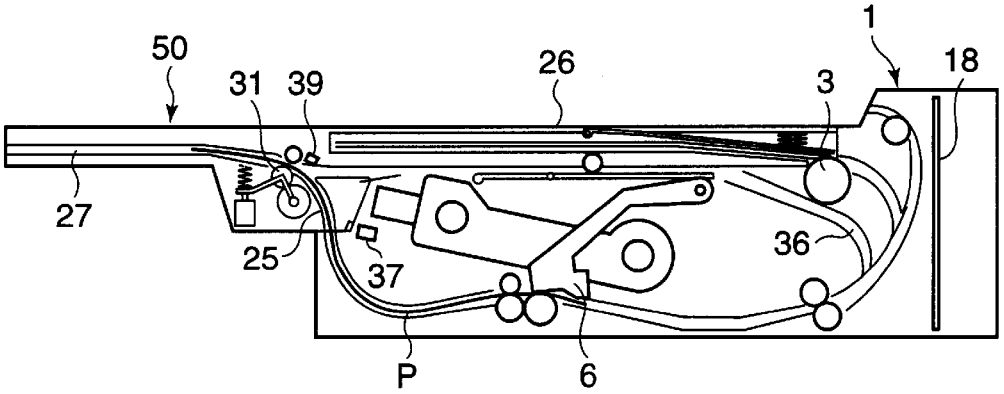
FIG. 7 is a side view which schematically shows the state where recording on the front side of the recording material is completed in the recording apparatus represented in FIG. 5.

FIG. 6 shows the state where the usual recording (recording on the surface side) is executed after the recording sheet P has been fed. The recording sheet P is pinched by the grip roller 41 and the pinch roller 42 to be carried, and the thermal head 6 records thereon. FIG. 7 shows the condition of the recording sheet P when recording is completed (for example, when one ink color has been thermally transferred).

In FIG. 7, the recording sheet P after recording (recording has been made thereon) is carried by way of the sheet carrying guide portion 25 underneath the central portion of the sheet cassette 2 to the sheet carrying guide portion 27 which is formed to be extend forward to the front side of the sheet cassette. At this juncture, the driving roller 31, which is incorporated in the sheet cassette 2, is biased by a biasing spring 30 in escaping direction from the recording sheet P (the direction in which sheet conduction passage is open) together with the arm 38 of the driving roller 31 so as not to exert any stress on the conveyance of the recording sheet P.

Figure 8:
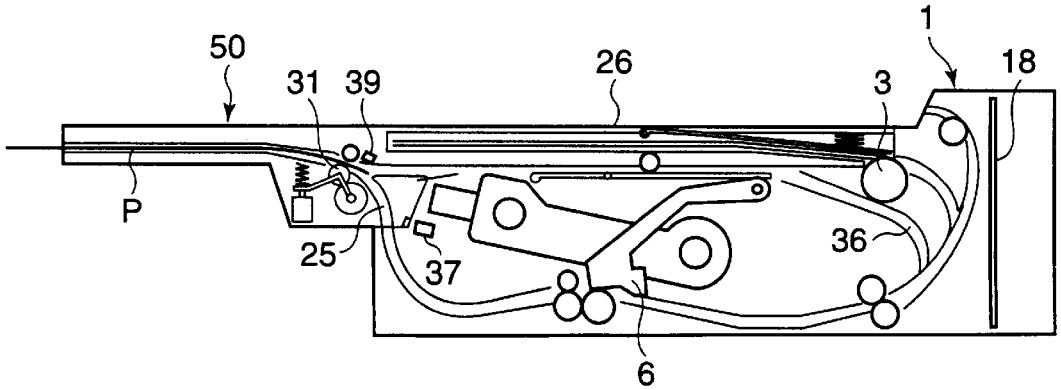
FIG. 8 is a side view which schematically shows the state where the recording material whose front side recording is completed is sent into the interior of the sheet cassette in the recording apparatus represented in FIG. 5 in order to perform the backside recording.

FIG. 8 shows the state where the recording sheet P is carried after recording further in the recording direction (the left direction in FIG. 5) for the execution of the double side recording. In FIG. 8, when the double side recording mode is in operation to record on the both sides of a recording sheet P, the recording sheet P, on which a first recording has been made (usually on the surface side), is carried further by use of control means (not shown) to the position (shown in FIG. 8) on the downstream side in the recording direction (in the left direction in FIG. 8). This position on the downstream side (the position shown in FIG. 8) corresponds to the position where the trailing end of the recording sheet P (the right side edge in FIG. 8) detected by a head detection sensor 39 (FIG. 5).

Here, by use of control means, a plunger 29 is actuated to overcome the biasing spring 30 and drive the arm 38 clockwise around the rotational center thereof. In other words, the arm 38 is provided integrally with a driving roller 31 and a driving gear unit 28. Then, when the arm 38 is driven to rotate clockwise, the driving roller 31 is pressed to the driven roller 32 to pinch the recording sheet P between them to carry it. In order to record on the backside (second recording), the recording sheet P is sent out (carried) by means of the driving roller 31 and the driven roller 32 in the direction toward the sheet reversing guide portion 33 and the auxiliary driving roller 35. The conveyance of the recording sheet P is then continued until the trailing end of the recording sheet (the left side edge shown in FIG. 8) is detected by the head detection sensor 39.

Figure 9:
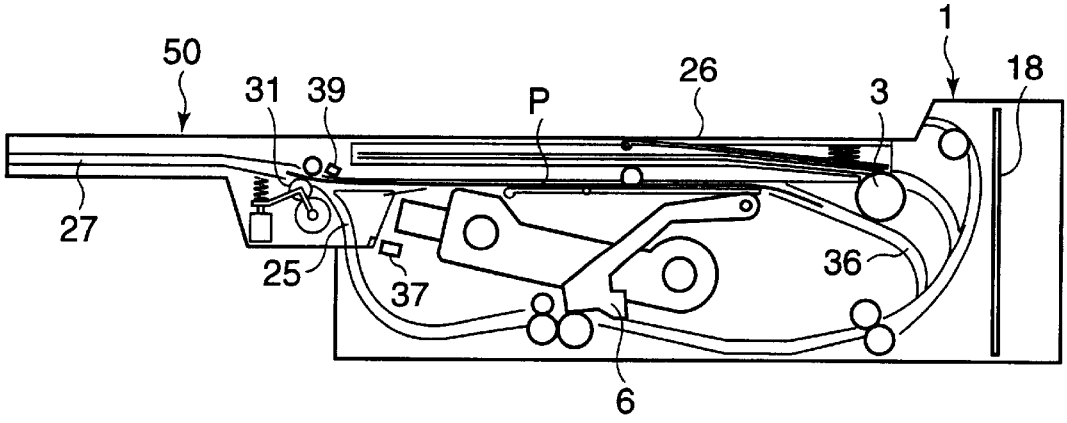
FIG. 9 is a side view which schematically shows the state where the recording material is again fed for the backside recording in the recording apparatus represented in FIG. 5.

FIG. 9 shows the state where the recording sheet P is again carried for backside recording. In FIG. 9, when control means receives the detection signal from the head detection sensor 39 to indicate the arrival of the trailing end (the right edge in FIG. 9) of the recording sheet P, the driving gear unit 28 is controlled by means of controlling signal from the aforesaid control means to be driven. Then, the recording sheet P, which has been carried as shown in FIG. 8 in the left direction in FIG. 9, is carried in the reverse direction (in the right direction shown in FIG. 9). Here, the recording sheet P is in the state of being pressed by the driving roller 31 to be in contact with the driven roller 32. In this state, the recording sheet P is carried in the reverse direction (in the right direction in FIG. 9). Thus, the carrying passage of the recording sheet P has been switched so that the leading end portion of the recording sheet P is carried to the sheet reversing guide portion 33 side.

After that, the recording sheet P is conducted to be carried, while being raised by means of a sheet conduction plate 34 to the sheet cassette 50 side (upper side), and advances to the re-conveyance guide portion 36 which is formed on the right side portion in FIG. 9 (front side) of the apparatus main body 1 through the upper portion of the thermal head 6 of the apparatus main body 1. After that, the recording sheet P is carried by the driving power of the driving auxiliary roller 35 which is arranged on the upper portion of the thermal head 6, and further carried through the guide portion 15-2 to be gripped (pinched) again by the grip roller 41 and the pinch roller 42. At this juncture, the recording sheet P is reversed upside down unlike the aforesaid first recording (where recording is usually made on the surface side). With the recording sheet P being pinched again by use of the grip roller 41 and the pinch roller 42, recording (second recording) begins on the backside thereof. Recording is executed on the backside in the same manner as the recording on the surface side as described earlier.

The driving system of the auxiliary driving roller 35 and the driving gear unit 28 are connected by means of a belt or a shaft, and the structure is arranged so that in synchronism with the rotational driving of the driving roller 31, the auxiliary driving roller 35 is driven to rotate in the same manner. With the operation described above, the carrying passage of the sheet (recording sheet P) for which the first recording operation (recording on the surface side) has been completed is automatically switched to reverse both faces of the recording sheet upside down, and the recording sheet is carried in this state for the execution of recording again on the recording face on the backside of the recording sheet (that is, the second recording). The operation of the second recording (recording on the backside) is essentially the same as the first recording (recording on the surface side) described above.

In accordance with the embodiment described above, there is no need for the apparatus main body thus miniaturized to be expanded for the arrangement of carrying passage for a certain recording sheet which is specially prepared for a particular purpose. It is possible to provide a recording apparatus capable of carrying each of recording sheets to be used for various ways, irrespectively of the apparatus main body which has been made sufficiently smaller, if only sheet cassette is prepared accordingly for each use.

In other words, with the structure in which the apparatus main body has been minimized in size, it is possible to record on each of various recording materials which are different in sizes only by replacing sheet cassettes. Also, it is possible to provide a recording apparatus capable of easily and reliably executing on each of various recording materials which are different in sizes the color recording that requires the repetition of reciprocating conveyance of the recording material through the recording unit.

Further, it is possible to provide a recording apparatus capable of automatically executing double side recording just by replacing sheet cassettes despite such miniaturization of the apparatus. Here, for the embodiments described above, the description has been made of the case, as an example, where the present invention is applied to a thermal transfer recording apparatus. However, with the effect equally obtainable, the invention is equally applicable to recording apparatuses of ink jet type, wire-dot type, thermosensitive type, laser beam type or some others.

Also, with the effect equally obtainable, the invention is equally applicable to various recording apparatuses having different scanning systems, such as the serial recording type where recording means (recording head) 6 moves in the main scanning direction or the line recording type where recording is made only by sub-scanning performed by line recording means having a length that covers a recording material in the widthwise direction thereof totally or partly.

Also, with the effect equally obtainable, the invention is equally applicable to a recording apparatus that performs monochromatic recording, a color recording apparatus that records in a plurality of different colors using one or plural recording heads, a gradation recording apparatus that records in plural densities having different densities in one and the same color, or further, a recording apparatus formed by combining them.

Further, when an ink jet recording apparatus is used, the invention is equally applicable, with the functional effect equally attainable, to the cases where recording means and ink retaining portions adopt various modes, such as recording means being an exchangeable ink jet cartridge (head cartridge) having recording head unit and ink retaining unit integrally formed or recording means being unexchangeable. In this respect, when an ink jet recording apparatus is used, the invention is applicable to recording means (recording head) that uses piezoelectric devices or some other electromechanical converting devices for instance, but of the ink jet recording apparatuses, the invention demonstrates superior effect by the one, in particular, that uses recording means of the type that discharges ink utilizing thermal energy, because, with the ink jet recording apparatus of such type, recording can be attained in higher density and higher precision.

As clear from the above description, in accordance with the invention, the structure is arranged so that there are provided a sheet cassette capable of detachably mountable for supplying recording material, and recording means for recording on recording material in accordance with recording information, and then, a part of carrying passage of recording material is formed on the sheet cassette, and also, a carrying passage, which is bent on the front side and backside of the recording apparatus, is formed by the carrying passage arranged for the sheet cassette and the carrying passage arranged in the apparatus main body, and that the recording unit is provided between these curved portions of the carrying passages in order to perform recording on the way of the carrying passage arranged in the apparatus main body. As a result, even for the structure in which the apparatus main body has been minimized in size, it is possible to record on each of various recording materials which are different in sizes only by replacing sheet cassettes. Also, it is possible to provide a recording apparatus capable of easily and reliably executing on each of various recording materials which are different in sizes the color recording that requires the repetition of reciprocating conveyance of the recording material through the recording unit.

Further, it is possible to provide a recording apparatus capable of recording on each of various recording materials having different sizes more efficiently just by replacing sheet cassettes on the apparatus main body the structure of which is minimized, and also, capable of easily and reliably executing on each of various recording materials which are different in sizes the color recording that requires the repetition of reciprocating conveyance of the recording material through the recording unit, because there are arranged for the apparatus the structure whereby to install the sheet cassette on the upper part of the apparatus main body with the upper surface of the sheet cassette being arranged to be the sheet expelling tray; the structure which is provided with carrying passage switching means for switching the carrying passage for feeding a recording material from the sheet cassette and the carrying passage for expelling the recording material after recording; and the structure in which each ink layer of an ink sheet having a plurality of ink color layers is transferred for recording by executing a plurality of reciprocating conveyances of the recording material along the carrying passages that include the recording unit, and then, the recording material is expelled onto the sheet expelling tray on the upper surface of the sheet cassette after recording or the structure in which, while a cassette discrimination mark is made on a sheet cassette to be used, the apparatus main body is provided with cassette discrimination detecting means for detecting the kind of the cassette by use of such cassette discrimination mark.

Furthermore, it is possible to provide a recording apparatus which is made still smaller than the aforesaid apparatus, but capable of automatically performing double side recording just by replacing sheet cassettes with the arrangement of structure in which the sheet cassette is provided with driving rollers, and carrying passage switching means for switching the carrying passages for a recording material, as well as with a sheet reversing guide portion, thus making it possible to carry the recording material, which is supplied to the recording unit of the apparatus main body, into the sheet cassette, and then, to carry the recording material thus carried into the sheet cassette again to the carrying passage in the apparatus main body through the sheet reversing guide portion that reverses the recording material upside down for recording in the recording unit to record both on the surface side and backside of the recording material.

What is claimed is:

1. A recording apparatus provided with a detachably mountable recording material cassette for supplying recording material to record on recording material by means of a recording head in accordance with recording information, comprising the following:

a first carrying passage for recording material formed on a part of recording material cassette;

a second carrying passage for said recording material formed in the interior of apparatus main body;

a third carrying passage formed by connecting said first carrying passage and said second carrying passage, said third carrying passage being provided with a curved carrying path to be curved on the front side and backside of recording apparatus; and a recording unit arranged on a location along said second carrying passage positioned to face said first carrying passage for holding said recording head, wherein said recording material cassette is installed on the upper part of apparatus main body, and the upper face of said recording material cassette becomes a sheet expelling tray portion.

2. A recording apparatus according to claim 1, further comprising:

carrying passage switching means for switching the carrying passage for feeding recording material from said recording material cassette and the carrying passage for expelling recording material after recording.

3. A recording apparatus according to claim 2, wherein said recording material cassette is provided with driving rollers and a recording material reversing guide portion, and the recording material supplied to the recording unit of apparatus main body can be carried into the interior of said recording material cassette, and then, the recording material carried into the interior of said recording material cassette is again carried to said second carrying passage through said recording material reversing guide portion to make conveyance possible for the recording material reversed upside down in order to record on both sides of said recording material.

4. A recording apparatus according to claim 1, wherein said recording material cassette is detachably mountable horizontally in the front and backside directions of apparatus main body, and interlocked with operation to remove said recording material cassette from apparatus main body, said recording head moves up and down, and then, plate members are arranged between said recording head and said recording material cassette to be made movable interlocked with the up and down movement of said recording head.

5. A recording apparatus according to claim 1, wherein the upper face of said recording material cassette is utilized as an alignment tray, and the lower face of said recording material cassette is utilized as a guide portion for guiding sheet during recording.

6. A recording apparatus according to claim 5, wherein in a state of said recording material cassette being removed, the user of apparatus is prevented by the presence of plate members from touching said recording head.

7. A recording apparatus according to claim 5, wherein in a state of said recording material cassette being installed, plate members function dually as guiding portion for sheet to be carried.

8. A recording apparatus according to claim 1, wherein said recording head is a thermal transfer recording head for transferring ink to recording material by heating an ink sheet.

9. A recording apparatus according to claim 8, wherein said ink sheet provided with a plurality of color ink layers, and each of ink layers is transferred for recording by carrying said recording material in plural reciprocation along said third carrying passage including said recording unit, and then, recording material is expelled after recording onto the sheet expelling tray portion on the upper face of said recording material cassette.

10. A recording apparatus according to claim 1, wherein said recording material cassette is provided with a cassette discrimination mark, and apparatus main body is provided with cassette discrimination detecting means for detecting the kind of cassette by means of said mark.

11. A recording apparatus for recording on recording material by means of a recording head held in a recording unit, comprising the following:

a recording material cassette for containing recording material, said recording material cassette being installed on the upper side of said recording unit inside apparatus main body, and detachably mountable in the same direction as the direction of carrying recording material during recording; and carrying means for expelling recording material from apparatus main body after guiding said recording material from said recording material cassette to said recording unit, said carrying means being arranged to carry recording material from the backside of apparatus main body into the interior of apparatus main body, at the same time, reversing recording material during recording from the front side in the interior of apparatus main body for the guiding thereof to said recording unit, and expelling said recording material after completion of recording from the rear side of upper face of apparatus main body toward the front side thereof, wherein said recording material cassette is detachably mountable horizontally in the front and backside directions of apparatus main body, and interlocked with operation to remove said recording material cassette from apparatus main body, said recording head moves up and down, and then, plate members are arranged between said recording head and said recording material cassette to be made movable interlocked with the up and down movement of said recording head.

12. A recording apparatus according to claim 11, wherein the upper face of said recording material cassette is utilized as an alignment tray, and the lower face of said recording material cassette is utilized as a guide portion for guiding sheet during recording.

13. A recording apparatus according to claim 11, wherein in a state of said recording material cassette being removed, the user of apparatus is prevented by the presence of said plate members from touching said recording head.

14. A recording apparatus according to claim 11, wherein in a state of said recording material cassette being installed, said plate members function dually as guiding portion for sheet to be carried.

15. A recording apparatus according to claim 11, wherein said recording head is a thermal head having a plurality of heating elements, and said recording apparatus is a thermal transfer recording apparatus for recording by transferring ink to sheet by heating ink sheet by use of said thermal head.

* * * * *

UNITED STATES PATENT AND TRADEMARK OFFICE

CERTIFICATE OF CORRECTION

PATENT NO. : 6,563,525 B2
DATED : May 13, 2003
INVENTOR(S) : Etsuro Suzuki

It is certified that error appears in the above-identified patent and that said Letters Patent is hereby corrected as shown below:

Title page,
Item [56], References Cited, insert
-- OTHER PUBLICATIONS
* Abstract of JP Laid-Open 5-193215, Kiyoshi et al., Printer Device, (8/3/93)
** Abstract of JP Laid-Open 7-40616, Minoru et al., Paper Feeder in Printer, --

Column 2,
Line 25, “It is” should read -- It is a --;
Line 55, “extremely” should read -- an extreme --.

Column 3,
Line 46, “extremely” should read -- an extreme --.

Column 5,
Line 45, “manes” should read -- means --.

Column 6,
Line 8, “over coated” should read -- overcoated --;
Line 13, “over” should read -- over- --.

Column 7,
Line 16, “contribute” should read -- contributes --.

Column 8,
Line 42, “pari” should read -- pair --.

Column 9,
Line 1, “Form” should read -- From --.

UNITED STATES PATENT AND TRADEMARK OFFICE

CERTIFICATE OF CORRECTION

PATENT NO. : 6,563,525 B2
DATED : May 13, 2003
INVENTOR(S) : Etsuro Suzuki

It is certified that error appears in the above-identified patent and that said Letters Patent is hereby corrected as shown below:

Column 13,
Line 3, “extend” should read -- extended --.

Signed and Sealed this

Twenty-seventh Day of January, 2004

JON W. DUDAS
*Acting Director of the United States Patent and Trademark Office*